US009190811B2

(12) United States Patent
Soelter

(10) Patent No.: US 9,190,811 B2
(45) Date of Patent: Nov. 17, 2015

(54) SURGE ARRESTER WITH A LOW RESPONSE VOLTAGE AND METHOD FOR PRODUCING SAME

(75) Inventor: Eberhard Soelter, Berlin (DE)

(73) Assignee: EPCOS AG, Munich (DE)

( * ) Notice: Subject to any disclaimer, the term of this patent is extended or adjusted under 35 U.S.C. 154(b) by 88 days.

(21) Appl. No.: 14/006,262

(22) PCT Filed: Mar. 21, 2012

(86) PCT No.: PCT/EP2012/055011

§ 371 (c)(1), (2), (4) Date: Oct. 29, 2013

(87) PCT Pub. No.: WO2012/126952

PCT Pub. Date: Sep. 27, 2012

(65) Prior Publication Data

US 2014/0063675 A1 Mar. 6, 2014

(30) Foreign Application Priority Data

Mar. 21, 2011 (DE) ..... 10 2011 014 582

(51) Int. Cl.

| | |
|---|---|
| ***H01T 1/24*** | (2006.01) |
| ***H01T 1/22*** | (2006.01) |
| ***H01T 4/12*** | (2006.01) |

(52) U.S. Cl.

CPC .. *H01T 1/24* (2013.01); *H01T 1/22* (2013.01); *H01T 4/12* (2013.01)

(58) Field of Classification Search

CPC ..... H01T 1/22; H01T 1/24; H01T 4/12

See application file for complete search history.

(56) References Cited

U.S. PATENT DOCUMENTS

| | | | | | |
|---|---|---|---|---|---|
| 3,676,743 | A | * | 7/1972 | Bahr et al. | 361/120 |
| 3,686,743 | A | | 8/1972 | Thillet | |
| 3,989,973 | A | * | 11/1976 | Lange et al. | 313/594 |
| 4,287,548 | A | * | 9/1981 | Hahndorff | 361/120 |
| 4,491,893 | A | | 1/1985 | Toda | |
| 4,837,050 | A | * | 6/1989 | Iwasa et al. | 427/97.3 |
| 6,118,648 | A | * | 9/2000 | Kojima et al. | 361/311 |
| 6,529,361 | B1 | * | 3/2003 | Petschel et al. | 361/120 |
| 7,643,265 | B2 | | 1/2010 | Loader et al. | |

FOREIGN PATENT DOCUMENTS

| | | | |
|---|---|---|---|
| CN | 1273689 | A | 11/2000 |
| CN | 1738134 | A | 2/2006 |
| DE | 2639816 | A1 | 3/1978 |
| DE | 102007063316 | A1 | 7/2009 |
| JP | 5824989 | | 2/1983 |
| JP | 62112880 | | 7/1987 |
| JP | 2000188169 | A | 7/2000 |
| JP | 2001516943 | A | 10/2001 |
| JP | 2004179111 | A | 6/2004 |
| JP | 2006-286294 | A | 10/2006 |
| JP | 2009508320 | A | 2/2009 |
| WO | 03049244 | A1 | 6/2003 |

* cited by examiner

*Primary Examiner* — Zeev V Kitov

(74) *Attorney, Agent, or Firm* — Slater & Matsil, L.L.P.

(57) ABSTRACT

A surge arrester includes a cavity formed by at least one insulating body and at least two electrodes, which extend into the cavity. The electrodes are oriented toward one another with their free ends and have an electrode spacing between one another. The electrodes include several different metallic materials in regions of the free ends.

13 Claims, 2 Drawing Sheets

SURGE ARRESTER WITH A LOW RESPONSE VOLTAGE AND METHOD FOR PRODUCING SAME

This patent application is a national phase filing under section 371 of PCT/EP2012/055011, filed Mar. 21, 2012, which claims the priority of German patent application 10 2011 014 582.6, filed Mar. 21, 2011, each of which is incorporated herein by reference in its entirety.

TECHNICAL FIELD

The invention relates to a surge arrester with a low response voltage, and a method for producing same.

BACKGROUND

German Patent Publication No. DE 10 2007 063 316 A1 discloses a surge arrester.

In the interior of the surge arrester, an arc flashover between two or three electrodes occurs when a specific limit voltage, the ignition voltage, is exceeded. The limit voltage is designated as response DC voltage Urdc in the case of static or steady-state loading with a voltage rise of 100 V/s, and as response surge voltage urs in the case of dynamic loading with a voltage rise of 1 kV/μs. The arc is maintained by the feeding current as long as the electrical conditions for the arc exist.

SUMMARY OF THE INVENTION

Embodiments of the invention specify a surge arrester that has a low response voltage, and also a production method therefor.

The surge arrester comprises a cavity formed by at least one insulating body. Two electrodes extend into the cavity from the sides, which electrodes are oriented toward one another with their free ends and have a spacing, the electrode spacing, from one another. In particular, the electrodes have the same longitudinal axis. In regions of the free ends, the electrodes contain a plurality of different metallic materials. In one embodiment, in each case one metallic material is embedded into another metallic material. Preferably, the embedding is effected into one or a plurality of electrode cavities. In particular, two or three metallic materials are arranged in the free end regions in such a way that they each have a surface which is open toward the respective other electrode.

The insulating body is formed from one piece or, particularly when a central electrode is provided in the region of the electrode spacing, of two pieces. Particularly advantageously, the at least one insulating body is shaped from ceramic. Preferably, the at least one insulating body is shaped in a tubular fashion and in particular in a cylindrical fashion. The electrodes are preferably embodied in a rod-shaped fashion.

The electrodes of the surge arrester are connected at their respective non-free ends to a respective end of the at least one insulating body to form the surge arrester. For this purpose, the non-free ends of the electrodes have a flange, which is connected to the at least one insulating body preferably in a gas-tight manner. Neon with an admixture of argon is preferably used as gas in the surge arrester. At the sides facing away from the insulating body, each flange has a connection, in particular having a screw thread, by means of which electrical contact can be made with the surge arrester or the electrodes thereof.

The surge arrester is designed for the following properties or tasks. The response DC voltage is between 55 volts and 70 volts, and the response surge voltage is lower than 700 volts. The pulse loading capacity in the case of a current loading is 100 kA (kiloamperes) in the case of a standard surge waveform 8 μs/20 μs, i.e., in the case of a rise time of 8 μs and a time to half-value of 20 μs. In the case of a surge waveform 10 μs/350 μs, i.e., a rise time of 10 μs and a time to half-value of 350 μs, the pulse loading capacity is 50 kA. Furthermore, the surge arrester enables a reliable response in the case of fault (failsafe) according to a current intensity-time characteristic. Owing to the failsafe within the surge arrester, the latter is suitable for use in an environment subject to explosion hazard, since no sparking occurs outside the surge arrester even in the case of flashover between the internal electrodes.

The surge arrester makes it possible for the first time to fulfill the extreme tasks mentioned above. As a result, it is possible to use the surge arrester as an individual component in areas in which more complex protective measures had to be implemented previously or in which such protection was not possible.

In the surge arrester, each of the electrodes contains a first metallic material, and a second metallic material in an electrode cavity of the first metallic material, said electrode cavity extending into the electrode from the free end. As a result, it becomes possible to select and design the two metallic materials with regard to the predetermined response voltages and the current pulse loading.

With regard to the failsafe properties of the surge arrester, the two metallic materials preferably have different melting points. This ensures, depending on the position of the root of an electrical discharge, the maintenance of the current-time characteristic of the internal failsafe between the electrodes. In the case of relatively low continuous loading, the second metallic material melts sooner than the first metallic material arranged further toward the outside. At relatively high currents, the root of the continuous discharge migrates toward the first metallic material and the latter melts.

The materials having different melting points make possible, in the case of different current intensities and at sufficiently high temperatures, an internal short circuit by means of melting and subsequent welding of the electrodes. Preferably, the melted materials of both electrodes bridge the electrode spacing—provided in the initial position—of the surge arrester and weld to form a metallic short circuit of both electrodes.

Advantageously, the electrodes have the same longitudinal axis and the melting points of the different metallic materials increase from the longitudinal axis in a radial direction.

The surge arrester is preferably designed in such a way that, in the case of its response, a discharge starts at two opposite regions of the second metallic material of the electrodes. As the discharge progresses, it also encompasses the first metallic material, which is preferably designed with regard to a higher current-carrying capacity than the first metallic material.

Advantageously, the electrode cavity of an electrode of the surge arrester is shaped in such a way that the second metallic material is connected to the first metallic material with low impedance and in a mechanically fixed manner. This makes it possible to optimize the electrical properties of the electrodes and the parameters of the surge arrester.

It is particularly advantageous if the electrode cavity of the surge arrester has an undercut, into which the second metallic material engages. This enables a very fixed mechanical or a force-locking connection of the two metallic materials which withstands even high forces produced by current, and a low resistance at the transition of the two metallic materials.

A particularly low resistance of the electrodes of the surge arrester arises if the second metallic material is produced on the basis of a copper paste or in particular on the basis of a sinterable copper paste. This enables cost-effective and safe production of the electrodes of the surge arrester. Particularly preferably, the copper paste is free of flux.

Advantageously, the second metallic material is sintered in the electrode cavity. This enables a very good electrical and mechanical connection of the two metallic materials.

In one particularly preferred embodiment, the first metallic material of the electrodes comprises an iron-nickel alloy. The latter is distinguished by a high current-carrying capacity.

Particularly advantageous conditions for ignition of the surge arrester are achieved by virtue of the free end of an electrode or of each electrode containing an activation compound. Advantageously expedient starting conditions for the response or ignition of the surge arrester become possible as a result. It is particularly advantageous if the surfaces of the free end of an electrode or of each of the electrodes have a honeycomb structure, in which the activation compound is arranged. In the case of large-area application of the activation compound to the second metallic material, containing copper in particular, a discharge regularly starts particularly advantageously and reliably in the region of the activation compound and thus in the copper-containing part of the electrodes.

In the method for producing a surge arrester, at least two electrodes are provided and are connected to the ends of at least one insulating body in a gas-tight manner, wherein the following steps are carried out. An electrode cavity is produced in the free end of each electrode, in particular by hollowing out by turning or undercutting the first metallic material of the electrode or by welding or soldering a ring onto an electrode main body. A metallic paste is then filled into the electrode cavity thus formed and the surface of the metallic paste is structured. An activation compound is then introduced into the structures of the surface of the metallic paste. After at least one of the steps, beginning with filling the metallic paste, the electrode is sintered. The sintered surface of the electrode is subsequently ground. After two electrodes of this type have been produced, which additionally have a flange and an outer connection, they are introduced into the cavity and connected by their flange to the at least one insulating body in a gas-tight manner in such a way that the electrode spacing in the cavity is very small, in particular less than 1 mm or preferably 0.5 mm.

Preferably, a copper paste is introduced into an electrode cavity of an electrode composed of an iron-nickel alloy and is sintered. After the sintering process, a wafer structure, in particular a honeycomb structure, is pressed into the sintered copper paste by means of a tool. After the grinding of the surface of the sintered copper paste and renewed sintering, the electrode activation compound is introduced into the honeycomb structure by means of dropwise paste coating. A final sintering process is then effected.

Particularly advantageously, the surge arrester is embodied in a cylindrical fashion with an external diameter of approximately 25 mm and a total length of 40 mm or approximately 23 without external connections.

In one advantageous embodiment, each electrode is embodied in composite fashion. The embodiment makes it possible, by using different metals and/or alloys, to provide optimized arrester conditions for the interior and at the same time to offer very good soldering or welding properties for the external connections of the electrodes.

It proves to be advantageous to provide an iron-nickel alloy, in particular $Fe_{58}Ni_{42}$, for the first metallic material and the flange of each electrode. It is thereby possible to achieve optimal properties in the interior cavity and during the closure soldering of the surge arrester.

In order to support the build-up of a discharge during the response of the surge arrester, it proves to be advantageous if the cavity or interior at the inner wall of the insulating body contains a plurality of ignition strips. The ignition steps extend right into the discharge rear space on both sides of the electrode spacing.

The surge arrester is explained in greater detail below on the basis of exemplary embodiments and the associated figures.

BRIEF DESCRIPTION OF THE DRAWINGS

The drawings described below should not be regarded as true to scale. Rather, for the sake of better illustration, individual dimensions may be illustrated in an enlarged, reduced or even distorted manner.

Identical elements or elements having identical functions are designated by the same reference signs.

DETAILED DESCRIPTION OF ILLUSTRATIVE EMBODIMENTS

Figure 1:
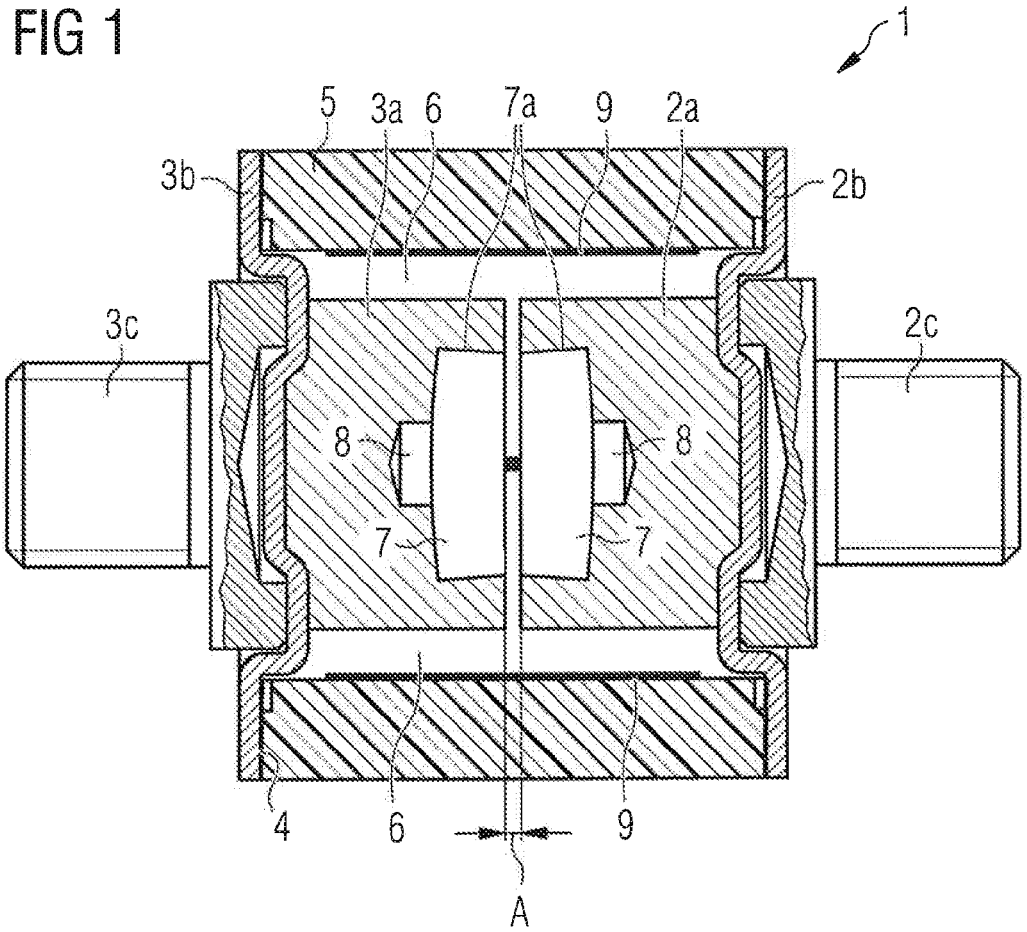
FIG. 1 shows a schematic diagram of a surge arrester in partial cross section.

FIG. 1 illustrates a first embodiment of a surge arrester 1 in (partial) cross section. The surge arrester has two electrodes assembled or soldered or welded from in each case a plurality of parts 2*a*, 2*b*, 2*c* and 3*a*, 3*b*, 3*c*. The flange 2*b*, 3*b* of each electrode terminates a tubular insulating body 5 with a cavity 6 on both sides by means of a closure soldering 4. The interior space of the surge arrester thus formed is closed off in a gas-tight manner and contains a gas composed very predominantly of neon with a small admixture of argon. The insulating body 5 is composed of ceramic material. The external connection 2*c*, 3*c* of each electrode is designed as a threaded bolt or screw body.

Each electrode 2, 3 comprises an iron-nickel alloy. Each internal electrode 2*a*, 3*a* is produced in a rod-shaped fashion from the iron-nickel alloy as first metallic material and contains an electrode cavity 7 having an undercut 7*a*. A sintered copper paste 10 is arranged as second metallic material in the electrode cavity 7 and, with the aid of the undercut 7*a* and a central blind hole 8, forms both an intimate or force-locking mechanical and a good electrical connection to the first metallic material. The undercut is provided in order that the copper paste remains and is not withdrawn during a response of the surge arrester and the high currents and forces associated therewith in the electrode. The blind hole 8 supports this by means of the enlarged area between the first and second metallic materials.

The distance between the end sides of the electrodes, i.e., the electrode spacing A at their free ends, is 0.5 mm. The insulating body 5 has, at its inner wall, a plurality of ignition strips 9 distributed over its circumference and arranged in a longitudinal direction. The ignition strips are not electrically connected to any of the electrodes.

Figure 2:
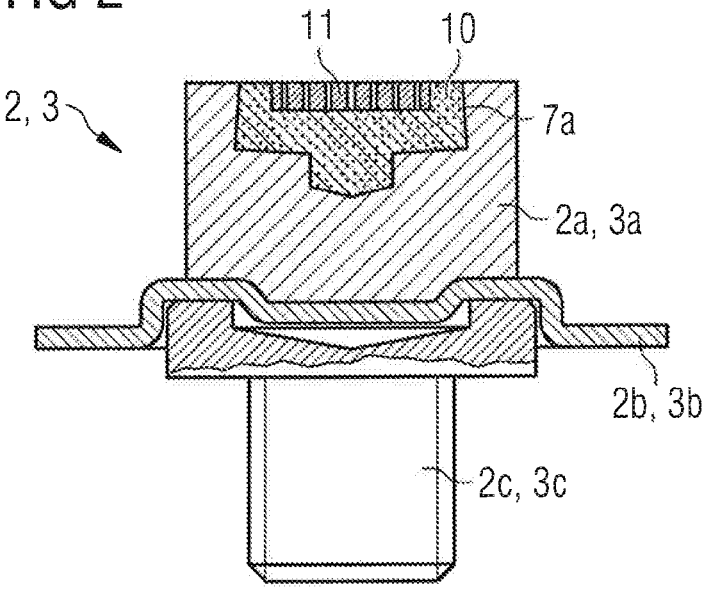
FIG. 2 shows an electrode of a surge arrester with flange and external connection.

In accordance with FIG. 2, the electrode 2 or 3 has the construction described in accordance with FIG. 1. A sintered copper paste 10 is arranged in the electrode cavity. After a flux-free copper paste has been introduced into the electrode cavity, the copper paste is repeatedly sintered and ground at its surface. The copper paste 10 at the free end of the electrode forms a matrix for an activation compound 11, which is preferably embedded over a large area into a honeycomb structure of the surface. The honeycomb structure is applied by means of a tool after the first sintering of the copper paste.

In one particularly advantageous embodiment, the sintered copper paste is pasted with the activation compound. The activation compound contains silicates and halides. Materials contained are, in particular, nickel, titanium, barium aluminate, barium titanate, sodium silicate, potassium silicate and cesium silicate, and cesium tungstate.

The surge arrester in accordance with the figures has the following performance features: response DC voltage Urdc between 55 volts and 70 volts, response surge voltage urs less than 700 volts, pulse loading capacity 100 kA in the case of a standard current pulse of the waveform 8/20 μs and 50 kA in the case of a standard current pulse of the waveform 10/350 μs.

Figure 3:
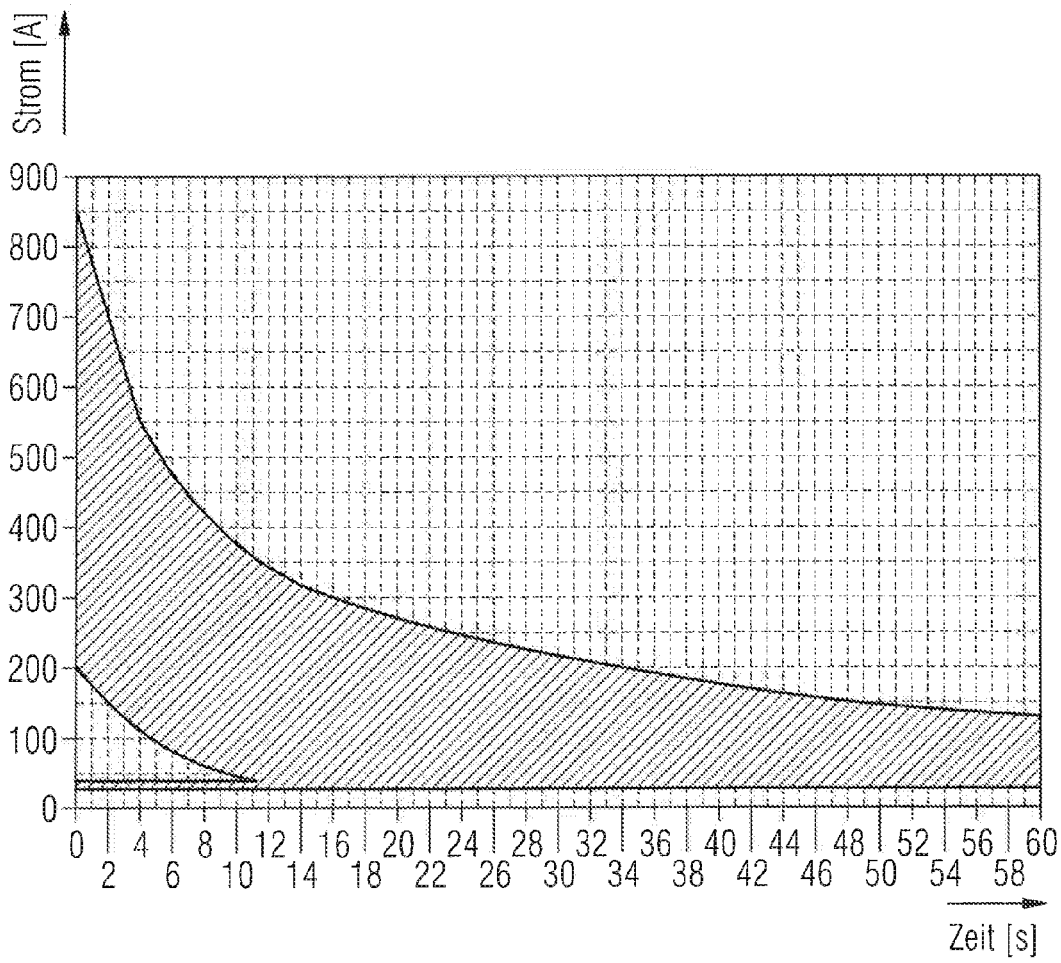
FIG. 3 shows a schematic illustration of the current-time characteristic of a surge arrester.

As a result of melting of the copper paste and/or the iron-nickel alloy according to a current-time characteristic in accordance with FIG. 3, a failsafe property results within the surge arrester. The internal failsafe property allows the surge arrester to be used in an environment subject to explosion hazards because no sparking occurs outside the surge arrester in the case of a fault.

The invention claimed is:

1. A surge arrester, comprising:

an insulated body having a cavity; and first and second electrodes, wherein the first and second electrodes extend into the cavity, wherein the first and second electrodes are oriented toward one another with their free ends, wherein the first and second electrodes have an electrode spacing between one another, wherein the first and second electrodes comprise several different metallic materials in regions of the free ends, and wherein each of the first and second electrodes comprises:

a first metallic material;

an electrode cavity disposed in the first metallic material, the electrode cavity extending into the first metallic material from a free end;

a second metallic material arranged in the electrode cavity of the first metallic material; and an activation compound disposed on the second metallic material, wherein the first and second metallic materials have different melting points, wherein a melting point of the second metallic material is lower than a melting point of the first metallic material, and wherein the first and second electrodes are placed in the insulating body such that a metallic short circuit is formed between the first and second electrodes by welding when materials of the first and second electrodes melt.

2. The surge arrester according to claim 1, wherein the electrode cavity is shaped in such a way that the second metallic material is connected to the first metallic material with low impedance and in a mechanically fixed manner.

3. The surge arrester according to claim 1, wherein the electrode cavity has an undercut into which the second metallic material engages.

4. The surge arrester according to claim 1, wherein the second metallic material is produced from a copper paste.

5. The surge arrester according to claim 1, wherein the second metallic material is sintered in the cavity.

6. The surge arrester according to claim 1, wherein a first metallic material of the electrodes comprises an iron-nickel alloy.

7. The surge arrester according to claim 1, wherein the free end of the first electrode comprises the activation compound.

8. The surge arrester according to claim 7, wherein surfaces of the free end of the electrode have a honeycomb structure, the activation compound being arranged in the honeycomb structure.

9. The surge arrester according to claim 1, wherein the surge arrester comprises a cylindrical arrangement, in which the first and second electrodes have the same longitudinal axis and the melting points of the different metallic materials increase from the longitudinal axis in a radial direction.

10. The surge arrester according to claim 1, wherein each electrode has a respective flange at its non-free end, the first and second electrodes being connected to a respective end of the insulating body in a gas-tight manner by the respective flange.

11. A method for producing a surge arrester, wherein at least two electrodes are provided and are connected to ends of at least one insulating body in a gas-tight manner, the method comprising:

providing a first electrode and a second electrode, wherein each of the first and second electrodes comprises a first metallic material;

producing an electrode cavity in a free end of each of the first and second electrodes;

arranging a second metallic material in the electrode cavity of each of the first and second electrodes;

structuring a surface of the second metallic material;

introducing an activation compound into the structures of the surface of the second metallic material, wherein the first and second metallic materials have different melting points, wherein a melting point of the second metallic material is lower than a melting point of the first metallic material;

sintering the first and second electrodes after introducing the activation compound; and placing the first and second electrodes in the insulating body such that a metallic short circuit is formed between the first and second electrodes by welding when materials of the first and second electrodes melt.

12. The method according to claim 11, wherein the second metallic material is a metallic paste.

13. The method according to claim 12, wherein the surface of the metallic paste is ground after sintering the electrodes.

* * * * *